US007938647B2

(12) United States Patent
Zheng et al.

(10) Patent No.: US 7,938,647 B2
(45) Date of Patent: May 10, 2011

(54) GROUNDING CONNECTOR HAVING A FLAT PORTION AND A CURVED CONTACTING PORTION WITH A PROTRUSION FOR CONNECTING TWO PRINTED CIRCUIT BOARDS

(75) Inventors: Ming-Zhi Zheng, Shenzhen (CN); Ji Zhou, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 0 days.

(21) Appl. No.: 12/774,066

(22) Filed: May 5, 2010

(65) Prior Publication Data

US 2011/0053389 A1 Mar. 3, 2011

(30) Foreign Application Priority Data

Aug. 26, 2009 (CN) ..... 2009 1 0306119

(51) Int. Cl.
*H01R 12/00* (2006.01)

(52) U.S. Cl. ..... 439/66

(58) Field of Classification Search ..... 439/108, 439/66, 92, 65, 515, 947, 948
See application file for complete search history.

(56) References Cited

U.S. PATENT DOCUMENTS 5,984,697 A * 11/1999 Moran et al. ..... 439/92
6,149,443 A * 11/2000 Moran ..... 439/66
7,168,986 B1 * 1/2007 Peng ..... 439/607.04

* cited by examiner

*Primary Examiner* — Chandrika Prasad
(74) *Attorney, Agent, or Firm* — Steven M. Reiss

(57) ABSTRACT

A portable electronic device includes two PCBs and a ground connector. The ground connector includes a flat, two legs, and an arm. The flat attaches the grounding connector to one of the PCBs. The two legs project from the flat and cooperatively defining a receiving space. The arm, extending from the flat, is received and extends of the receiving space and electronically connecting to the other PCB.

12 Claims, 4 Drawing Sheets

GROUNDING CONNECTOR HAVING A FLAT PORTION AND A CURVED CONTACTING PORTION WITH A PROTRUSION FOR CONNECTING TWO PRINTED CIRCUIT BOARDS

BACKGROUND

1. Technical Field

The present disclosure relates to ground connectors and, particularly, to a ground connector used in a portable electronic device.

2. Description of Related Art

Electronic devices usually include a plurality of electrical components to realize different functions. In order to prevent electrostatic charges from damaging the electrical components, a grounding mechanism is usually provided for removal of electromagnetic interference and electrostatic charges.

However, a conventional grounding structure is usually fixed between two printed circuit boards (PCBs) in an electronic device. If the device should suffer an impact, damaging contact may occur between the PCBs and grounding structure.

Therefore, there is room for improvement within the art.

BRIEF DESCRIPTION OF THE DRAWINGS

Many aspects of the exemplary ground connector can be better understood with reference to the following drawings. The components in the drawings are not necessarily drawn to scale, the emphasis instead being placed upon clearly illustrating the principles of the portable electronic device utilizing the ground connector. Moreover, in the drawings, like reference numerals designate corresponding parts throughout the several views, in which.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
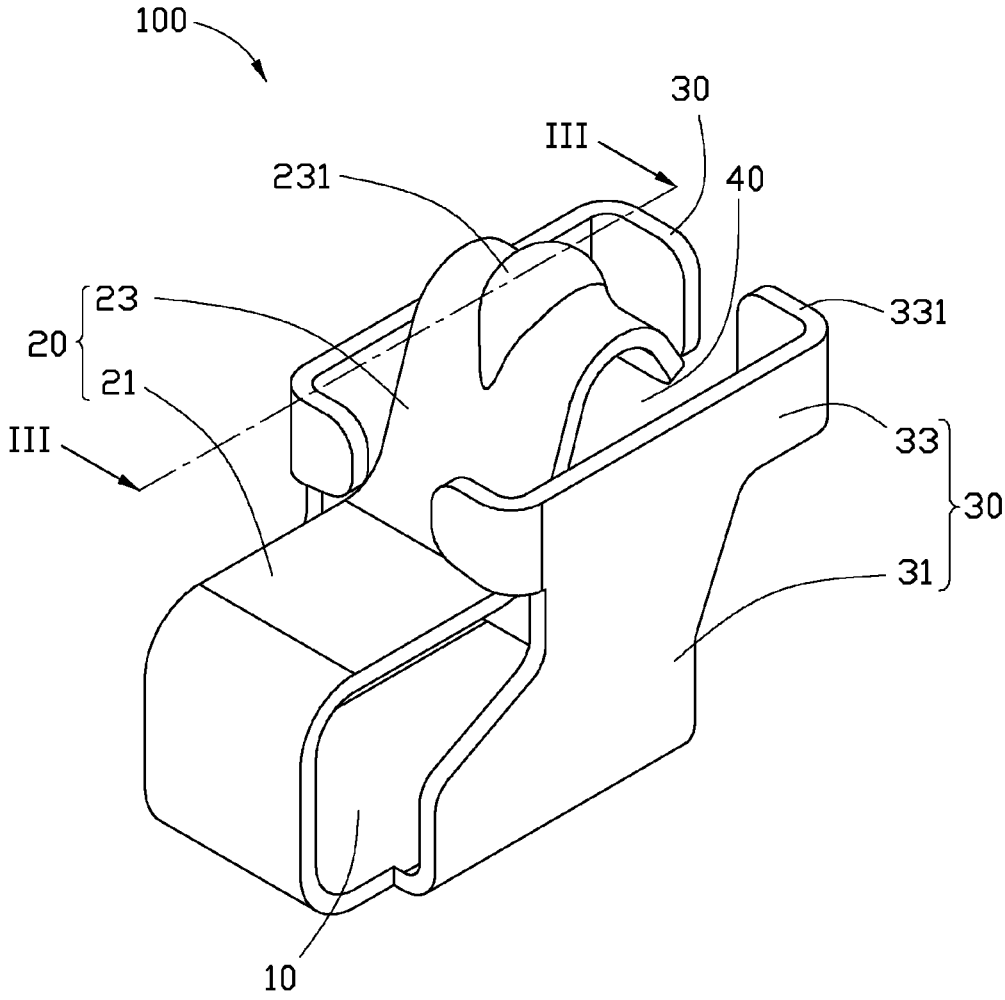
FIG. 1 is an isometric view of an exemplary embodiment of a grounding connector of a portable electronic device.

FIG. 1 is an isometric view of an exemplary embodiment of a ground connector 100 for use in a portable electronic device 200 (shown in FIG. 3), such as a cellular phone, game player, PDA (personal digital assistant) and so on. The ground connector 100 is made of metal, and is integrally formed, e.g., by stamping or punching from a metal sheet. The ground connector 100 includes a flat portion 10, an arm 20, and two legs 30. The arm 20 serpentinely extends from one edge of the flat portion 10. The two legs 30 substantially perpendicularly project from two opposite sides of the flat portion 10. A receiving space 40 is defined between the two legs 30, in which the arm 20 is received. A highest point of the arm 20, described below as protrusion 231, extends higher than the two legs 30 when the ground connector is in an uncompressed state.

The arm 20 includes a connecting portion 21 and a contacting portion 23. The connecting portion 21 perpendicularly extends from one edge of the flat portion 10, and then extends parallels to the flat portion 10. The contacting portion 23 first curves away from one end of the connecting portion 21, reaches a curved peak, and then curves back towards the flat portion 10 such that the contacting portion 23 is generally curved. A protrusion 231 projects from and above the curved peak of the contacting portion 23.

Figure 2:
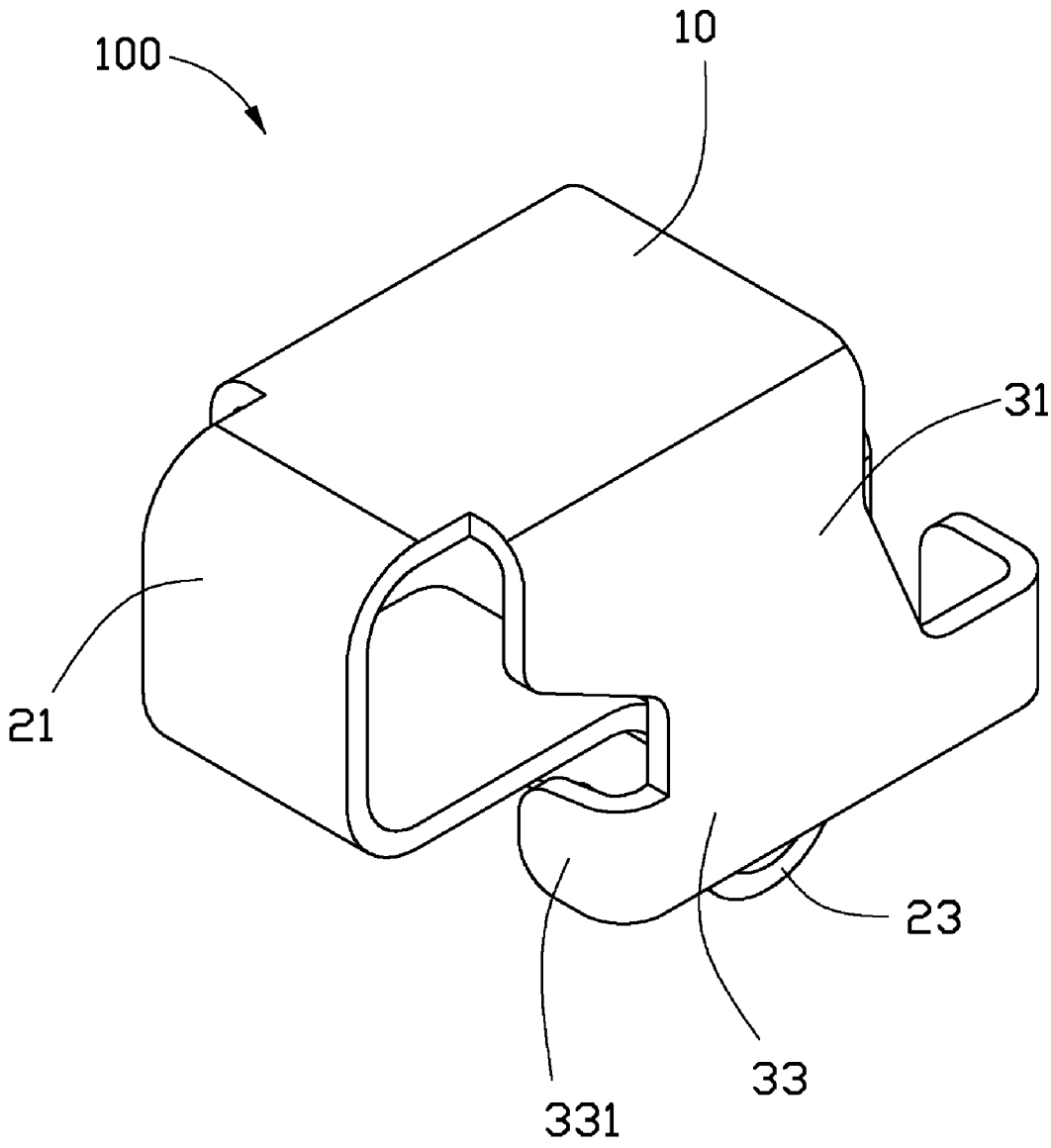
FIG. 2 is similar to FIG. 1, but viewed from another aspect.

Referring also to FIG. 2, each leg 30 includes a supporting portion 31 and a resisting portion 33. The supporting portion 31 projects substantially perpendicularly from one side of the flat portion 10. A tab 331 projects perpendicularly from each end of the resisting portion 33. The two tabs 331 at the same side face each other.

Figure 3:
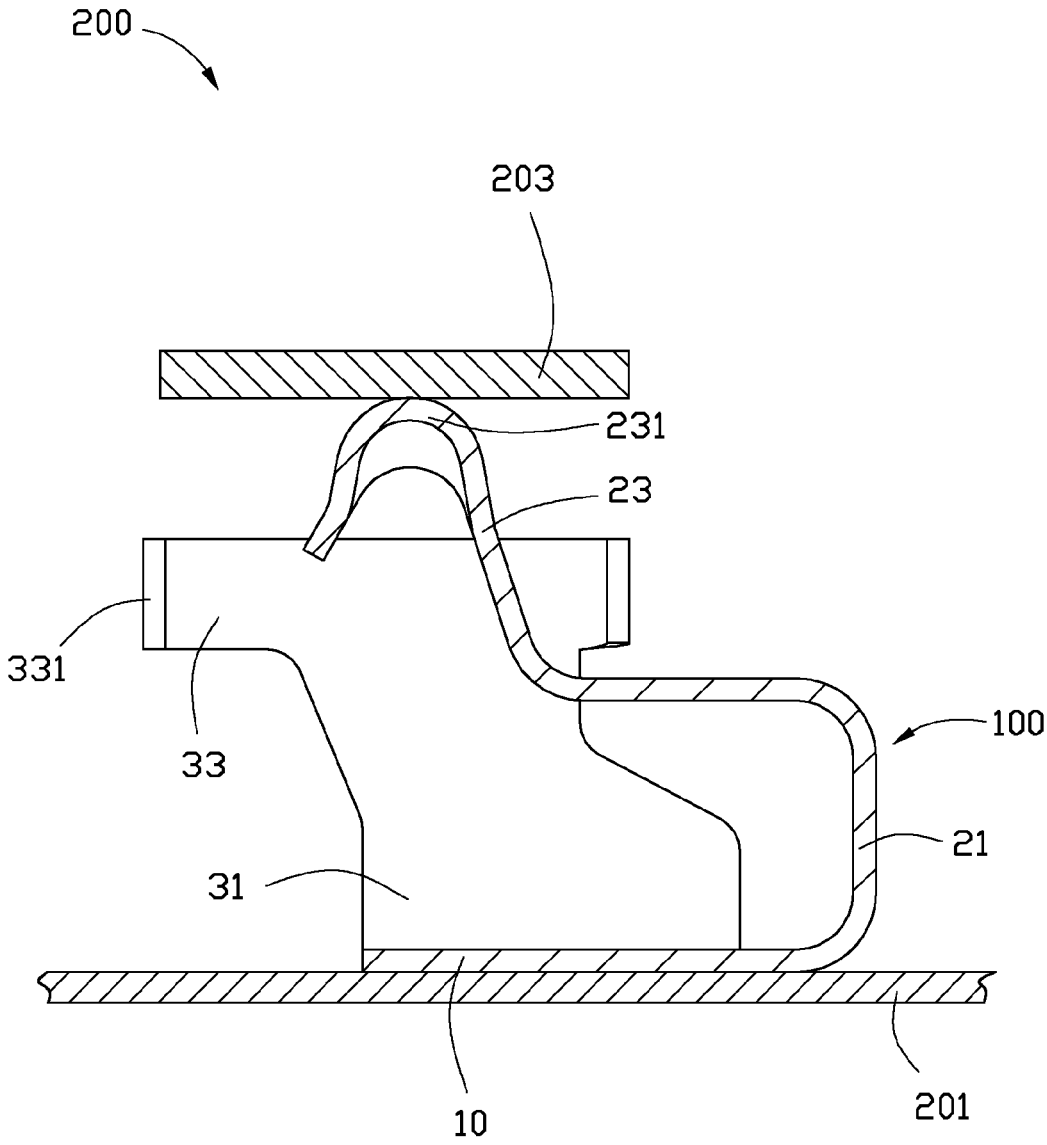
FIG. 3 is a cross-sectional view of a portable electronic device, showing the ground connector of FIG. 1 along line III-III.

Referring to FIG. 3, the device 200 further includes a first PCB 201 and a second PCB 203. The grounding connector 100 is positioned between the first PCB 201 and the second component 203 and configured for electrically connecting the first PCB 201 to the second PCB 203. In the exemplary embodiment, the first and second PCBs 201 and 203 may be, for example, a circuit of a keyboard of the device 200 and an underlying main printed wiring board (PWB).

During assembly, the first PCB 201 is secured by a suitable fastener (not illustrated), such as a bolt, to the device 200. The flat portion 10 of the grounding connector 100 is fixed to the first PCB 201 by another fastener (not illustrated), heat-melting, or welding. The second PCB 203 is secured by another suitable fastener (not illustrated) with a predetermined spacing between the two PCBs 201 and 203. The spacing is generally equal to the uncompressed height of the grounding connector 100 such that the two PCBs 201 and 203 electronically connect to each other and the resisting portions 33 are distant from the second PCB 203.

Figure 4:
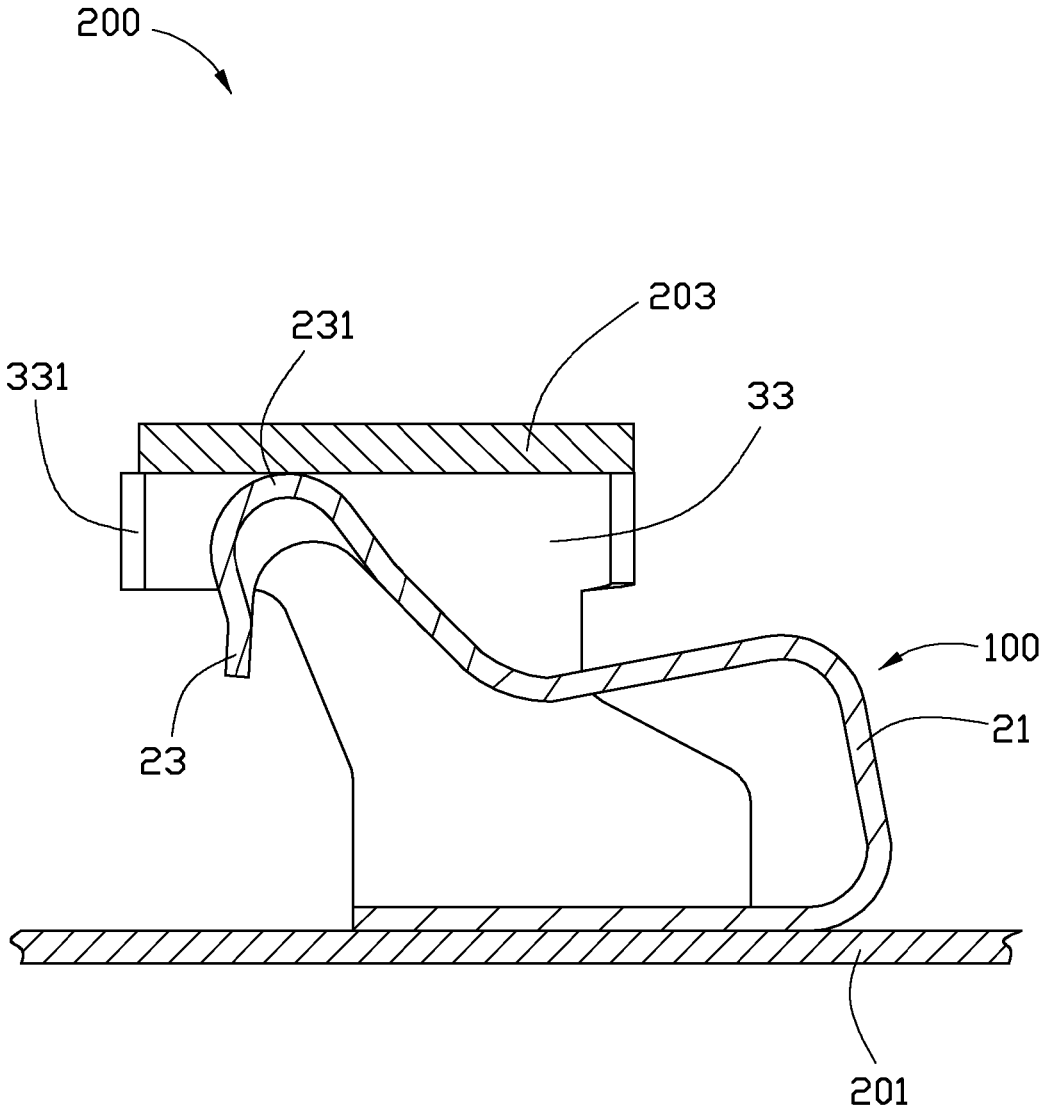
FIG. 4 is similar to FIG. 3, but showing the grounding connector in a deformed state.

Referring to FIG. 4, if an impact on the device 200 causes the second PCB 203 to move towards the first PCB 201, the contacting portion 23 is elastically compressed. This absorbs at least some of the energy of the impact. The supporting portions 31 of legs 30 resist against the second PCB 203 and act as limiters to maintain a predetermined standoff between the PCBs 201 and 203. Thus the grounding connector 100 provides a simple, one-piece device for protecting the PCBs 201 and 203 by limiting deflection of the PCBs 201 and 203.

It is to be understood that more than one grounding connector 100 can be provided if desired. The spacing between the first PCB 201 and the second PCB 203 can be larger than the uncompressed height of the grounding connector 100 such that the grounding connector 100 can act as an elastic ejecting device configured for e.g., a button so that the two PCBs 201 and 203 are electronically connected to each other by the grounding connector 100 when desired.

It is believed that the present embodiments and their advantages will be understood from the foregoing description, and it will be apparent that various changes may be made thereto without departing from the spirit and scope of the disclose or sacrificing all of its material advantages, the examples hereinbefore described merely being preferred or exemplary embodiments of the disclosure.

What is claimed is:

1. A grounding connector for mounting between a first printed circuit board and a second printed circuit board, the grounding connector comprising:

a flat portion configured for attaching the grounding connector to the first printed circuit board;

two legs projecting from the flat portion and defining a receiving space therebetween;

an arm extending from the flat portion, the arm including a connecting portion and a contacting portion, the contacting portion first curving away from one end of the connecting portion, reaching a curved peak, and then curving back towards the flat portion such that the contacting portion is generally curved; a protrusion projecting from and above the curved peak of the contacting portion, the protrusion being higher than the legs, the protrusion electronically connected to the second printed circuit board, and the legs resisting the second printed circuit board when the second printed circuit board is pressed to move toward the first printed circuit board.

2. The grounding connector as claimed in claim 1, wherein the contacting portion is V-shaped.

3. The grounding connector as claimed in claim 1, wherein each of the legs comprises a supporting portion projecting from the flat portion and a resisting portion for resisting the second printed circuit board when the grounding connector is in a compressed state.

4. The grounding connector as claimed in claim 3, wherein a tab projects from each of the resisting portions, the tabs at the same side face each other.

5. A portable electronic device comprising:

a first printed circuit board;

a second printed circuit board; and a grounding connector comprising:

a flat portion attaching to the first printed circuit board;

two legs projecting from the flat portion and defining a receiving space therebetween;

an arm extending from the flat portion, the arm including a connecting portion and a contacting portion, the contacting portion first curving away from one end of the connecting portion, reaching a curved peak, and then curving back towards the flat portion such that the contacting portion is generally curved; a protrusion projecting from and above the curved peak of the contacting portion, the protrusion being higher than the legs, the protrusion electronically connected to the second printed circuit board, and the legs resisting the second printed circuit board when the second printed circuit board is pressed to move toward the first printed circuit board.

6. The portable electronic device as claimed in claim 5, wherein the contacting portion is V-shaped.

7. The portable electronic device as claimed in claim 5, wherein the legs each comprise a supporting portion projecting from the flat portion and a resisting portion for resisting the second printed circuit board when the grounding connector is in a compressed state.

8. The portable electronic device as claimed in claim 7, wherein a tab projects from each of the resisting portions, the tabs at the same side face each other.

9. A portable electronic device comprising:

a first printed circuit board and a second printed circuit board positioned with a predetermined spacing;

a grounding connector including:

a flat portion attaching the grounding connector to the first printed circuit board;

two legs projecting from the flat portion and defining a receiving space therebetween;

an arm extending from the flat portion, the arm including a connecting portion and a contacting portion, the contacting portion first curves away from one end of the connecting portion, reaches a curved peak, and then curves back towards the flat portion such that the contacting portion is generally curved; a protrusion projects from and above the curved peak of the contacting portion, the protrusion being higher than the legs, the protrusion electronically connected to the second printed circuit board, and the legs resisting the second printed circuit board.

10. The portable electronic device as claimed in claim 9, wherein the contacting portion is V-shaped.

11. The portable electronic device as claimed in claim 9, wherein the legs each comprise a supporting portion projecting from the flat portion and a resisting portion for resisting the first and second printed circuit boards PCBs when the grounding connector is in a compressed state.

12. The portable electronic device as claimed in claim 11, wherein a tab projects from each of the resisting portions, the tabs at the same side face each other.

* * * * *